US007469486B2

(12) United States Patent
Tamura et al.

(10) Patent No.: US 7,469,486 B2
(45) Date of Patent: Dec. 30, 2008

(54) HEAT PUMP TYPE DRYING APPARATUS DRYING APPARATUS AND DRYING METHOD

(75) Inventors: Tomoichiro Tamura, Kyoto (JP); Yuuichi Yakumaru, Osaka (JP); Fumitoshi Nishiwaki, Hyogo (JP)

(73) Assignee: Matsushita Electric Industrial Co., Ltd., Kadoma-shi (JP)

( * ) Notice: Subject to any disclaimer, the term of this patent is extended or adjusted under 35 U.S.C. 154(b) by 374 days.

(21) Appl. No.: 10/549,579

(22) PCT Filed: Sep. 24, 2004

(86) PCT No.: PCT/JP2004/014417

§ 371 (c)(1),
(2), (4) Date: Sep. 19, 2005

(87) PCT Pub. No.: WO2005/031231

PCT Pub. Date: Apr. 7, 2005

(65) Prior Publication Data

US 2006/0179681 A1 Aug. 17, 2006

(30) Foreign Application Priority Data

Sep. 25, 2003 (JP) ..... 2003-333221

(51) Int. Cl.
*F26B 21/06* (2006.01)

(52) U.S. Cl. ..... 34/77; 34/73; 34/76; 34/474; 62/503

(58) Field of Classification Search ..... 34/73, 34/76, 77; 62/93, 156, 158, 503
See application file for complete search history.

(56) References Cited

U.S. PATENT DOCUMENTS

| | | | | |
|---|---|---|---|---|
| 5,113,882 | A | 5/1992 | Gileta | |
| 6,035,551 | A | 3/2000 | Scheufler et al. | |
| 6,434,857 | B1 * | 8/2002 | Anderson et al. | 34/595 |

FOREIGN PATENT DOCUMENTS

| | | |
|---|---|---|
| DE | 44 09 607 | 10/1994 |

(Continued)

OTHER PUBLICATIONS

Chinese Office Action mailed Nov. 30, 2007 with English translation (10 pages).

*Primary Examiner*—Kenneth B Rinehart
(74) *Attorney, Agent, or Firm*—Kratz, Quintos & Hanson, LLP

(57) ABSTRACT

A drying apparatus has a heat pump comprising a compressor (31), a radiator (32), a throttle apparatus (33) and an evaporator (34), and also includes a structure in which drying air heated by heat of the radiator (32) is introduced to a subject (37) to be dried is dehumidified by the evaporator (34). The drying apparatus also includes a bypass circuit (39) through which a portion of dying air heated by the radiator (32) flows to an inlet of the evaporator (34) without coming into contact with the subject, a super heat detecting device (43, 44) for detecting super heat of the heat pump apparatus, and a throttle apparatus control device for controlling flow path resistance in the bypass circuit (39) using a value detected by the super heat detecting device (43, 44).

13 Claims, 4 Drawing Sheets

FOREIGN PATENT DOCUMENTS

| | | | |
|---|---|---|---|
| DE | 44 09 607 | A1 | 10/1994 |
| EP | 1 273 468 | A | 1/2003 |
| GB | 378 384 | A | 8/1932 |
| GB | 1133098 | * | 11/1964 |
| JP | 7-178289 | | 7/1995 |
| JP | 2001-198396 | | 7/2001 |

* cited by examiner

HEAT PUMP TYPE DRYING APPARATUS DRYING APPARATUS AND DRYING METHOD

TECHNICAL FIELD

The present invention relates to a heat pump type drying apparatus, drying apparatus, and drying method used for drying clothes, a bathroom or any other item which needs to be dried, or for dehumidifying a room.

BACKGROUND OF THE INVENTION

A conventional heat pump type drying apparatus uses a heat pump as a heat source, and circulates drying air. For example, FIG. 6 shows the conventional heat pump type drying apparatus as described in Japanese Patent Application Laid-open No.H7-178289.

In FIG. 6, a clothes drying apparatus body 1 includes a rotation drum 2 used as a dry room which is rotatably provided in the body 1. The body 1 is operated by a motor 3 through a drum belt 4. A blower 22 sends drying air from the rotation drum 2 to a circulation duct 18 through a filter 11 and a rotation drum-side air intake 10. The blower 22 is operated by the motor 3 through a fan belt 8. A heat pump apparatus comprises an evaporator 23 which evaporates a refrigerant to dehumidify the drying air, a condenser 24 which condenses the refrigerant and heats the drying air, a compressor 25 for generating a pressure difference in the refrigerant, an expansion mechanism 26 such as a capillary tube for maintaining the pressure difference of the refrigerant, and a pipe 27 through which the refrigerant flows. A portion of drying air heated by the condenser 24 is discharged out from the body 1 through an exhaust port 28. The arrow B shows a flow of the drying air.

Next, an operation of the above mentioned conventional apparatus will be explained. First, clothes 21 to be dried are put in the rotation drum 2. Next, if the motor 3 is operated, the rotation drum 2 and the blower 22 are rotated and a flow B of the drying air is generated. The drying air deprives moisture from the clothes 21 in the rotation drum 2, and as a result, the drying air which includes the moisture is sent into the evaporator 23 of the heat pump apparatus through the circulation duct 18 by the blower 22. The drying air from which heat is deprived by the evaporator 23 is dehumidified, the drying air is sent to the condenser 24 and is heated, and then the drying air is circulated back into the rotation drum 2. An exhaust port 19 is provided in an intermediate portion of the circulation duct 18. Drain water which has been generated and dehumidified by the evaporator 23 is discharged through the exhaust port 19. As a result, the clothes 21 are dried.

However, the above conventional structure has a problem that the compressor compresses liquid when the heat pump is operated in a high temperature atmosphere and under a low air quantity condition.

A situation in which the compressor compresses liquid when the heat pump is operated in the high temperature atmosphere will be explained. In the heat pump type drying apparatus having the circulation duct, an input from an external power supply to the compressor and an amount of heat released outside from air circulating in the duct become equal to each other. That is, if the input to the compressor is constant, a difference between the atmosphere temperature and the average temperature of air in the circulation duct is always constant. Therefore, if the atmosphere temperature rises, the average temperature of air in the circulation duct also rises. For this reason, if the refrigerant pressure sucked by the compressor rises, the discharged refrigerant pressure also rises, and the pressure exceeds a permissible pressure of the compressor. As a measure against this problem, in a current product, an input (frequency) of the compressor is lowered in the high temperature atmosphere. By using this measure, the average temperature of the air in the duct is lowered, and the permissible pressure of the compressor is maintained. However, there are problems that the frequency in the compressor is reduced, the refrigerant circulation amount is also reduced and thus, a heat exchange amount of the evaporator is reduced, and the refrigerant is not completely vaporized in the evaporator. Liquid refrigerant remaining in the evaporator exit becomes a cause of liquid compression of the compressor. If the compressor compresses liquid, a stress exceeding the permissible value is applied to the compressor, and there is an adverse possibility that the constituent part is damaged.

Next, a situation in which the compressor compresses liquid when the heat pump is operated under the low air quantity condition will be explained. If the air quantity is reduced, the air-side heat transfer coefficient in a radiator and the evaporator is lowered. Therefore, a temperature difference between the refrigerant and air which is required for securing the same heat exchange amount is increased, a compressor sucking pressure is lowered and a discharging pressure is increased. In this case, the input (frequency) of the compressor is also controlled to be reduced so as to maintain the permissible pressure of the compressor similar to the case in which the compressor is operated in the high temperature atmosphere. As a result, there is a problem that the refrigerant is not completely vaporized in the evaporator.

Further, in the conventional structure, there is a problem that when the heat pump is actuated in a low temperature atmosphere or under the low air quantity condition, since the evaporator pressure, i.e., the evaporator temperature is lowered, frost forms on the evaporator.

Next, a condition in which the evaporator pressure is lowered when the heat pump is operated in the low temperature atmosphere will be explained. As described above, if the inputs to the compressor are the same, a difference between the atmosphere temperature and the average temperature of air in the circulation duct is always constant. Therefore, if the atmosphere temperature is lowered, the average temperature of air in the circulation duct is lowered. For this reason, a pressure of a refrigerant which is discharged from and sucked by the compressor is lowered, and the temperature of the refrigerant in the evaporator becomes lower than 0°, and there is a problem that frost forms on the evaporator.

Next, a condition in which a pressure in the evaporator is lowered when the heat pump is operated under the low air quantity condition will be explained. As described above, if the air quantity is reduced, the compressor sucking pressure is lowered, and the discharging pressure is increased. If the sucking pressure is lowered, the temperature of the refrigerant in the evaporator becomes lower than 0 and there is a problem that frost forms on the evaporator.

Further, HFC refrigerant (including atoms of hydrogen, fluorine and carbon in its molecule) which is currently used as a refrigerant of the heat pump apparatus directly affects the global warming. Thus, a natural refrigerant such as $CO_2$ existing in the nature has been proposed as an alternative refrigerant. However, if $CO_2$ refrigerant is used, a theoretical efficiency of the heat pump system is lower than that of the HFC refrigerant, and there is a problem that the operating efficiency of the heat pump type drying apparatus is lowered.

Therefore, using a natural refrigerant such as $CO_2$ which does not directly affect the global warming, it is necessary to realize energy-conservation and a high efficiency so as to reduce the indirect influence on the global warming.

The present invention has been accomplished to solve the conventional problems, and it is an object of the invention to provide a heat pump type drying apparatus in which when a refrigerant which can be brought into a supercritical state on the radiating side of a heat pump cycle such as $CO_2$ is used, compression of liquid refrigerant of the compressor and pressure reduction of the evaporator can be avoided even in a high/low temperature atmosphere and under the low air quantity condition, and high efficiency is realized.

SUMMARY OF THE INVENTION

A first aspect of the present invention provides a drying apparatus for drying a subject, wherein a refrigerant is circulated through a compressor, a radiator, an expansion mechanism and an evaporator through pipes, the drying apparatus comprising: a drying air flow path operable to introduce drying air heated by the radiator to the subject to be dried, dehumidify the drying air which has been introduced to the subject by using the evaporator, and, heat the dehumidified drying air to return it into the drying air; and a bypass circuit through which a portion of the drying air heated by the radiator flows to the evaporator without coming into contact with the subject to be dried.

According to a second aspect of the invention, in the drying apparatus of the first aspect, the drying apparatus further comprises a bypass circuit flow rate detecting device operable to detect a flow rate of the drying air which flows into the bypass circuit; and a bypass air flow rate adjusting device operable to adjust the flow rate of the drying air flowing into the bypass circuit using a value detected by the bypass circuit flow rate detecting device.

According to a third aspect of the invention, in the drying apparatus of the first aspect, the drying apparatus further comprises a super heat detecting device operable to detect super heat which is a difference between a refrigerant suction temperature of the compressor and a refrigerant evaporation temperature of the evaporator; and a bypass air flow rate adjusting device operable to adjust a flow rate of drying air flowing into the bypass circuit using a value detected by the super heat detecting device.

According to a fourth aspect of the invention, in the drying apparatus of the first aspect, the drying air flowing through the bypass circuit heat-exchanges with a portion of the pipes which is located between the compressor and the evaporator.

According to a fifth aspect of the invention, in the drying apparatus of the first aspect, the drying apparatus further comprises a temperature detecting device operable to detect a temperature of the drying air dehumidified by the evaporator; and a bypass air flow rate adjusting device operable to adjust a flow rate of the drying air flowing into the bypass circuit using a value detected by the temperature detecting device.

According to a sixth aspect of the invention, in the drying apparatus of the first aspect, in relation to a point at which the drying air passing through the bypass circuit meets the drying air passing through the subject to be dried, the drying air passing through the bypass circuit reaches the meeting point from a position located below the meeting point in a direction of gravity of the drying air passing through the subject to be dried.

According to a seventh aspect of the invention, in the drying apparatus of the first aspect, the drying air flow path is provided with a refrigerant accommodating container operable to accommodate a refrigerant.

According to an eighth aspect of the invention, in the drying apparatus of the seventh aspect, the refrigerant accommodating container is disposed in the drying air flow path at a location between a downstream portion of the radiator and an upstream portion of the evaporator.

According to a ninth aspect of the invention, in the drying apparatus of the first aspect, the compressor, radiator, and expansion mechanism are operated in a state in which a high pressure side thereof is in a supercritical state.

According to a tenth aspect of the invention, a heat pump type drying apparatus comprises a heat pump having a compressor, a radiator, an expansion mechanism and an evaporator connected via pipes through which a refrigerant is circulated; a drying air flow path operable to introduce drying air heated by the radiator to a subject to be dried, dehumidify the drying air which has been introduced to the subject by using the evaporator, and heat the dehumidified drying air to return it into the drying air; and a bypass circuit through which a portion of the drying air heated by the radiator flows to the evaporator without coming into contact with the subject to be dried.

According to a eleventh aspect of the invention, in the heat pump type drying apparatus of the tenth aspect, the drying apparatus further comprises a bypass circuit flow rate detecting device operable to detect a flow rate of the drying air which flows into the bypass circuit; and a bypass air flow rate adjusting device operable to adjust the flow rate of the drying air flowing into the bypass circuit using a value detected by the bypass circuit flow rate detecting device.

According to a twelfth aspect of the invention, in the heat pump type drying apparatus of the tenth aspect, the drying apparatus further comprises a super heat detecting device operable to detect super heat which is a difference between a refrigerant suction temperature of the compressor and a refrigerant evaporation temperature of the evaporator; and a bypass air flow rate adjusting device operable to adjust a flow rate of drying air flowing into the bypass circuit using a value detected by the super heat detecting device.

According to a thirteenth aspect of the invention, in the heat pump type drying apparatus of the tenth aspect, the drying air flowing through the bypass circuit heat-exchanges with a portion of the pipes which is located between the compressor and the evaporator.

According to a fourteenth aspect of the invention, in the heat pump type drying apparatus of the tenth aspect, the drying apparatus further comprises a temperature detecting device operable to detect a temperature of the drying air dehumidified by the evaporator; and a bypass air flow rate adjusting device operable to adjust a flow rate of the drying air flowing into the bypass circuit using a value detected by the temperature detecting device.

According to a fifteenth aspect of the invention, in the heat pump type drying apparatus of the tenth aspect, in relation to a point at which the drying air passing through the bypass circuit meets the drying air passing through the subject to be dried, the drying air passing through the bypass circuit reaches the meeting point from a position located below the meeting point in a direction of gravity of the drying air passing through the subject to be dried.

According to a sixteenth aspect of the invention, in the heat pump type drying apparatus of the tenth aspect, the heat pump type drying apparatus further comprises: a refrigerant accommodating container disposed in the drying air flow path to accommodate a refrigerant.

According to a seventeenth aspect of the invention, in the heat pump type drying apparatus of the sixteenth aspect, the refrigerant accommodating container is disposed in the drying air flow path at a location between a downstream portion of the radiator and an upstream portion of the evaporator.

According to a eighteenth aspect of the invention, in the heat pump type drying apparatus of the tenth aspect, the heat pump is operated in a state in which a high pressure side thereof is in a supercritical state.

According to a nineteenth aspect of the invention, a drying method is provided for drying a subject located within a circuit, the drying method comprising: dehumidifying and heating air to obtain drying air having a high temperature and low moisture; passing a portion of the drying air through the circuit to bring the portion of the drying air into contact with the subject; passing another portion of the drying air through a bypass circuit, the bypass circuit being arranged to avoid the another portion of the drying air from coming into contact with the subject; and mixing the portion of the drying air passed through the circuit and brought into contact with the subject with the another portion of the air passed through the bypass circuit to obtain the air.

According to a twentieth aspect of the invention, in the drying method of the nineteenth aspect, the drying method further comprises adjusting a flow rate of the drying air which is passed through the bypass circuit.

According to a twenty-first aspect of the invention, in the drying method of the twentieth aspect, the drying method further comprises detecting a temperature of the air after it is dehumidified and controlling the adjusting the flow rate of the drying air which is passed through the bypass circuit by using the detected temperature.

According to the above structure, the conventional problems of the liquid compression of the compressor and the pressure reduction of the evaporator can be avoided in a high/low temperature atmosphere and under a low air quantity condition, and it is possible to realize a heat pump type drying apparatus that can be operated more efficiently.

DETAILED DESCRIPTION

Embodiments of the present invention will be explained with reference to the drawings.

First Embodiment

Figure 1:
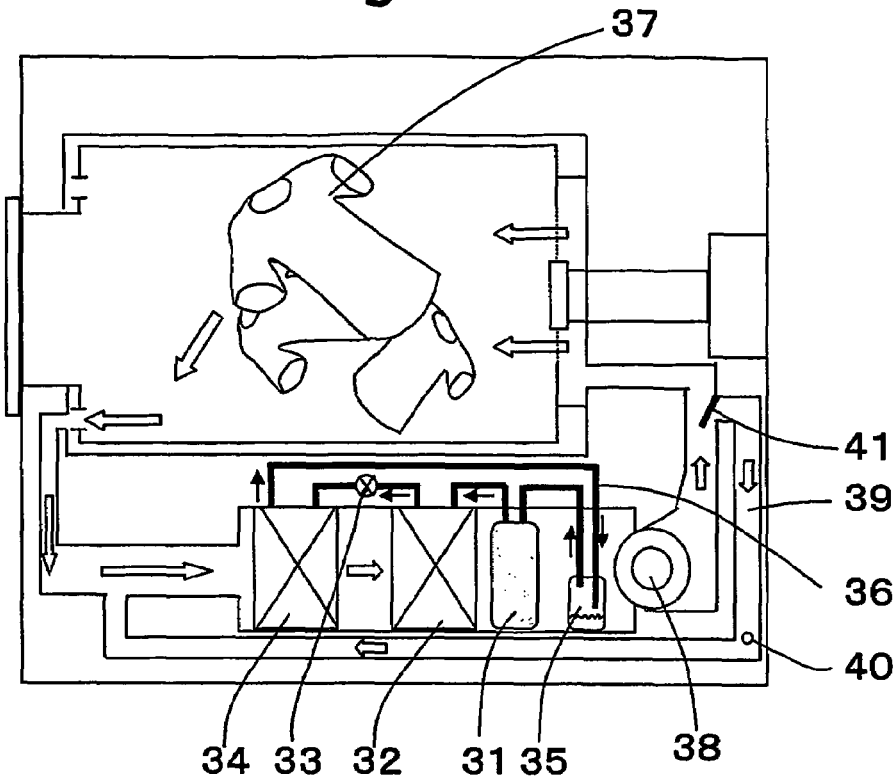
FIG. 1 is a block diagram of a heat pump type drying apparatus according to a first embodiment.

FIG. 1 is a block diagram of a heat pump type drying apparatus according to a first embodiment of the present invention. In FIG. 1, a heat pump apparatus is constituted by connecting a compressor 31, a radiator 32, an expansion valve 33 provided as an expansion mechanism, an evaporator 34 and a refrigerant accommodating container 35 to one another through pipes 36, and by charging a refrigerant thereinto. As the refrigerant, a refrigerant which can be brought into the supercritical state on the radiation side (compressor 31, discharge section to radiator 32 to expansion valve 33, inset section), e.g., $CO_2$ refrigerant is charged. A reference number 37 represents a subject to be dried. For example, the subject could be clothes, bathroom space or any other item which needs to be dried. A reference number 38 represents a fan, a reference number 39 represents a bypass circuit, a reference number 40 represents a bypass circuit air flow rate detecting device, a reference number 41 represents an open/close valve as an example of a bypass air flow rate adjusting device. In FIG. 1, solid arrows indicate a flow of the refrigerant, and hollow arrows indicate a flow of the drying air.

Next, an operation of the first embodiment will be explained. The refrigerant is compressed by the compressor 31 and brought into a high temperature and high pressure state. The refrigerant is heat-exchanged in the radiator 32 with drying air received from the evaporator 34, and the refrigerant heats the drying air. With this, the refrigerant is cooled, decompressed by the expansion valve 33, and is brought into low temperature and a low pressure state. The refrigerant is heat-exchanged by the evaporator 34 with drying air which passes through the subject 37, thereby cooling the drying air. Moisture or water included in the drying air is condensed and dehumidified, thereby heating the refrigerant, and the refrigerant is again sucked into the compressor 31. Therefore, the drying air dehumidified by the evaporator 34 in the drying air flow path is heated by the radiator 32, and is brought into a high temperature and low moisture state. The drying air brought into the high temperature and low moisture state deprives moisture from the subject and is brought into a humid state when the drying air is forcibly brought into contact with the subject 37 by the fan 38, and the drying air is again dehumidified by the evaporator 34. This is the drying operation for depriving moisture from the subject 37.

This first embodiment has the bypass circuit 39 through which a portion of the drying air heated by the radiator 32 flows to an inlet of the evaporator 34 without coming into contact with the subject 37. Therefore, enthalpy of air around the inlet of the evaporator 34 can be increased. This is because the bypass circuit 39 has smaller radiation than the circuit which passes through to the subject, and air having higher temperature can be supplied to the evaporator 34. If the enthalpy of air around the inlet of the evaporator 34 is increased, a heat exchanging amount in the evaporator 34 is increased, super heat is increased, and an evaporator pressure rising effect can be obtained. Therefore, the conventional problems of the liquid compression of the compressor and the pressure reduction of the evaporator can be avoided, and the heat pump cycle can be operated in a safe state.

In this first embodiment, the bypass circuit 39 is provided therein with the bypass circuit air flow rate detecting device 40, and the open/close valve 41 capable of adjusting the flow rate of the drying air which flows into the bypass circuit 39 using a value detected by the bypass circuit air flow rate detecting device 40.

With this structure, the flow rate of air in the bypass circuit 39 is not varied depending upon draft resistance of the subject 37, and it is always possible to flow air having a predetermined flow rate.

In this first embodiment, in relation to a point at which drying air which passed through the bypass circuit 39 meets the drying air which passed through the subject 37, the drying air which passed through the bypass circuit 39 reaches the meeting point from a position located below the meeting point in a gravity direction of the drying air which passed through the subject 37.

With this structure, the drying air which passed through the bypass circuit 39 and the drying air which passed through the subject 37 are mixed uniformly. This is because the drying air which passed through the bypass circuit 39 has a smaller specific gravity than that of the drying air which passed through the subject 37. Since the drying air which passed through the bypass circuit 39 and the drying air which passed through the subject 37 are mixed uniformly, a temperature distribution of the drying air around the inlet of the evaporator 34 becomes uniform, and the ability and performance of the evaporator 34 can be maximized.

In this embodiment, the refrigerant accommodating container 35 which accommodates the refrigerant in the heat pump apparatus is disposed in the drying air flow path at a location between a downstream portion of the radiator and an upstream portion of the evaporator.

With this structure, a temperature range and an air quantity range within which the heat pump type drying apparatus can be operated are increased. This is because the surplus liquid refrigerant is accommodated in the refrigerant accommodating container 35, and it is possible to prevent liquid from flowing back to the compressor. Further, since the refrigerant accommodating container 35 is disposed at a position downstream from the radiator in the drying air flow path, the refrigerant accommodating container 35 is heated by hot air after it has passed through the radiator and the likelihood of evaporation of liquid refrigerant is increased, thereby enhancing the liquid flow-back avoiding effect to the compressor.

When a $CO_2$ refrigerant is used, the radiating side is brought into the supercritical state and the heat exchanging efficiency between the drying air and the $CO_2$ refrigerant having a high temperature in the radiator 32 can be enhanced. Therefore, as compared with HFC refrigerant in which a condensing region exists on the radiating side, the drying air is heated to a high temperature. Thus, the enthalpy of drying air which flows into the bypass circuit is increased, the liquid compression avoiding effect of the compressor and the evaporator pressure rising effect are enhanced. That is, the temperature range within which the heat pump type drying apparatus can be operated and the air quantity region can further be increased.

Although the expansion valve is used in this first embodiment, even if an expansion mechanism such as a capillary tube is used, the same effect can be obtained.

Second Embodiment

Figure 2:
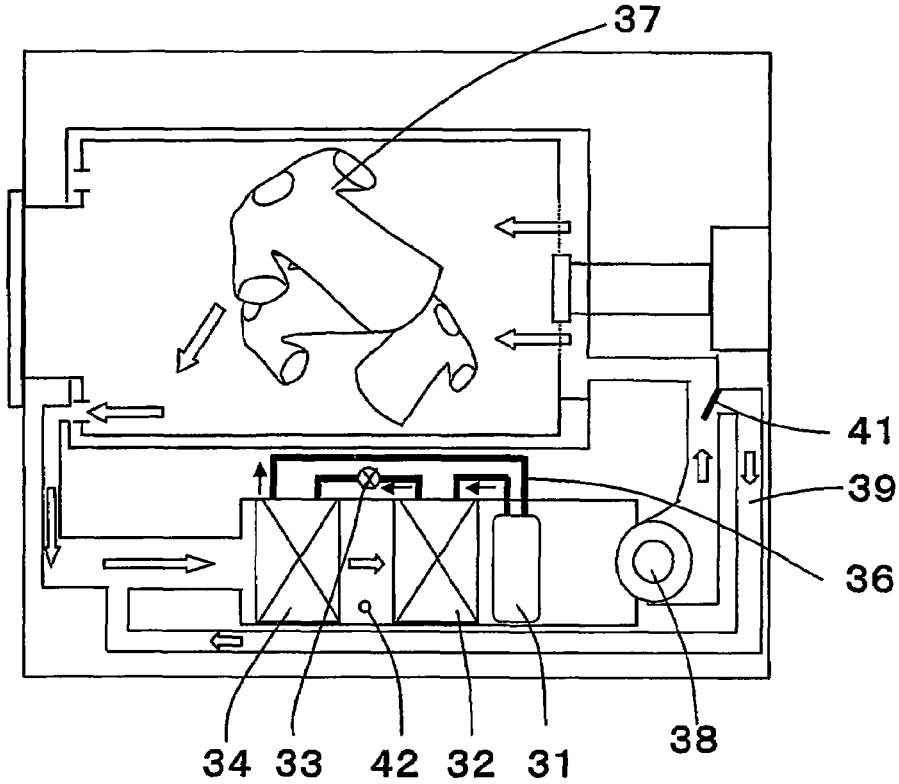
FIG. 2 is a block diagram of a heat pump type drying apparatus according to a second embodiment.

FIG. 2 is a block diagram of a heat pump type drying apparatus according to a second embodiment of the invention. In FIG. 2, common constituent elements shown in FIG. 1 are designated with the same reference symbols, and explanation thereof will be omitted. A heat pump apparatus is constituted by connecting the compressor 31, the radiator 32, the expansion valve 33 and the evaporator 34 to one another through pipes 36, and by charging the refrigerant thereinto. As the refrigerant, a refrigerant which can be brought into a supercritical state on the radiating side, such as a $CO_2$ refrigerant for example, is charged.

In this embodiment, in a duct between the radiator 32 and the evaporator 34, there are provided a temperature sensor 42 which detects a temperature of a drying air dehumidified by the evaporator 34, and the open/close valve 41 capable of adjusting the flow rate of the drying air which flows into the bypass circuit using a value detected by the temperature sensor 42.

Figure 3:
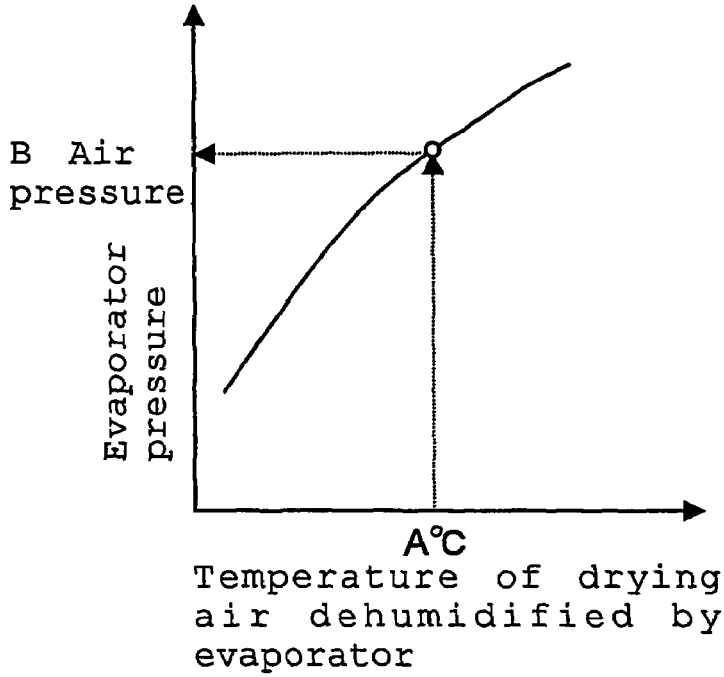
FIG. 3 shows a relation between a pressure of an evaporator and a temperature of drying air dehumidified by the evaporator.

According to this structure, a pressure (evaporation temperature) of the evaporator 34 can be calculated from a value detected by the temperature sensor 42. This is because the pressure in the evaporator 34 and the temperature of the drying air dehumidified by the evaporator 34 have a correlation as shown in FIG. 3, and if one of them is detected, the other one is uniquely determined. Further, if the open/close valve 41 is used, it is possible to adjust the flow rate of drying air flowing into the bypass circuit in accordance with the calculated pressure value of the evaporator 34. That is, if an opening of the open/close valve 41 is adjusted, the enthalpy of air around the inlet of the evaporator 34 can be controlled, and the pressure in the evaporator 34 can be controlled. Therefore, if the opening of the open/close valve 41 is adjusted and the pressure in, the evaporator 34 is optimally controlled from the actuation to the completion of the drying operation of the heat pump type drying apparatus, it is possible to prevent the pressure in the evaporator from being reduced, the drying time can be shortened and thus, energy conservation can be realized.

Next, the control method of the evaporator pressure will be explained in detail. When the heat pump type drying apparatus is actuated, air temperature in the duct is low, and the enthalpy of air around the inlet of the evaporator 34 is low. Therefore, the pressure in the evaporator 34 is reduced and thus, an input to the compressor 31 is limited to a value in which drying air dehumidified by the evaporator 34 becomes 0° C. or higher. The reduction of the input to the compressor 31 means the reduction of net heat quantity transferred to air in the duct. Therefore, the likelihood of experiencing a rising speed of the temperature of air in the duct is reduced. According to this embodiment, however, when the heat pump type drying apparatus starts up, the open/close valve 43 is fully opened, and the flow rate of air in the bypass circuit 38 is maximized. As a result, it is possible to increase the temperature of air around the inlet of the evaporator 34 as compared with the conventional technique. Thus, the input to the compressor 31 can be increased, and the rising speed of the temperature of air in the duct can be increased. After the temperature of air in the duct reaches a target value, the opening of the open/close valve 41 is adjusted, and the pressure in the evaporator 34 is controlled to the optimal pressure. With this, the drying time can be shortened as compared with the conventional technique, and the energy conservation can be realized. Generally, as the pressure in the evaporator 34 is higher, the performance of the compressor 31 is enhanced (performance enhancing factor) due to a reduction of the compression ratio (ratio of the discharging pressure and the sucking pressure of the compressor 31). However, the dehumidifying ability of the evaporator 34 is deteriorated (performance deteriorating factor). That is, the optimal value which depends on the compressor performance characteristics and the dehumidification ability characteristics exists in the pressure of the evaporator 34.

It is also possible to control the pressure in the evaporator by using an outside air temperature sensor which detects the temperature of outside air. This is because if the relation between the outside air temperature, the opening of the open/close valve 41 and the pressure in the evaporator are formulated in a table, and if the opening of the open/close valve 41 is determined in accordance with a value detected by the outside air temperature sensor, then the pressure in the evaporator can be arbitrarily set. Even if the drying air temperature sensor which detects the temperature of drying air is used instead of the outside air temperature sensor, the same effects can be obtained.

Third Embodiment

Figure 4:
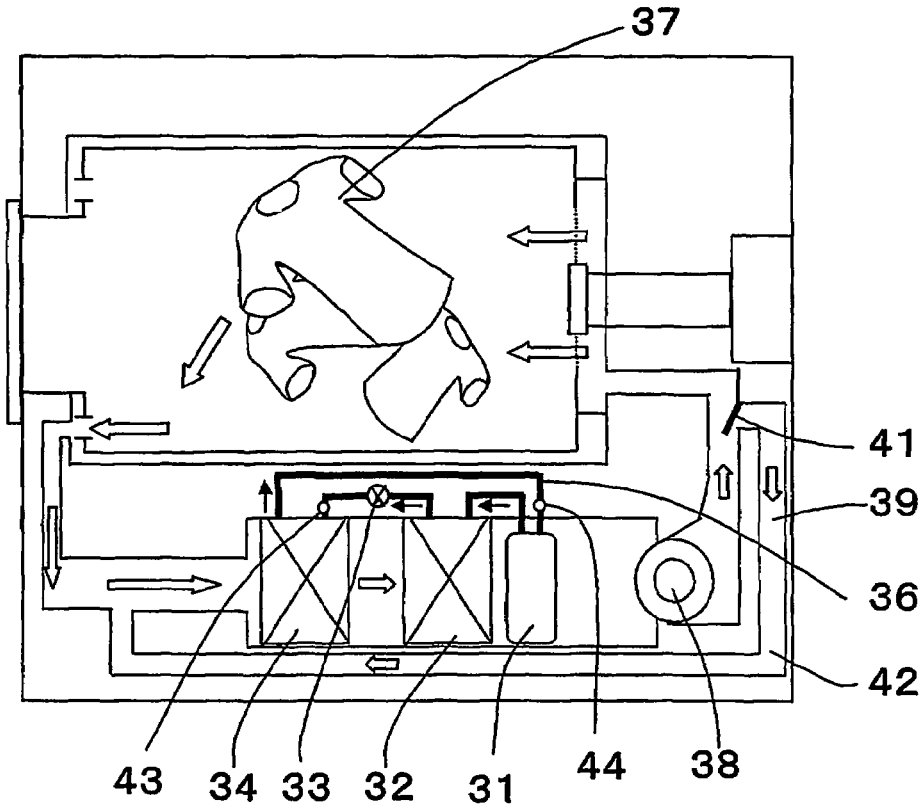
FIG. 4 is a block diagram of a heat pump type drying apparatus according to a third embodiment.

FIG. 4 is a block diagram of a heat pump type drying apparatus according to a third embodiment of the invention. In FIG. 4, common constituent elements shown in FIG. 1 are designated with the same reference symbols, and explanation thereof will be omitted. A heat pump apparatus is constituted by connecting the compressor 31, the radiator 32, the expansion valve 33 and the evaporator 34 to one another through pipes 36, and by charging the refrigerant thereinto. As the refrigerant, a refrigerant which can be brought into a supercritical state on the radiating side, such as a $CO_2$ refrigerant for example, is charged.

This embodiment has the bypass circuit 39 through which a portion of the drying air heated by the radiator 32 flows to an inlet of the evaporator 34 without coming into contact with the subject 37, a super heat detecting device (a for example, temperature sensor 43) for detecting the temperature of refrigerant around the inlet of the evaporator 34 and a temperature sensor 44 for detecting the temperature of refrigerant around the exit of the evaporator 34), and the open/close valve 41 capable of adjusting the flow rate of drying air which flows into the bypass circuit using a value detected by the super heat detecting device.

According to this structure, the flow rate of drying air flowing into the bypass circuit can be adjusted in accordance with the detected super heat value. That is, if an opening of the open/close valve 41 is adjusted, the enthalpy of air around the inlet of the evaporator 34 can be controlled, and the super heat value can be controlled. Therefore, if the opening of the open/close valve 41 is adjusted and the super heat value is optimally controlled from the actuation to the completion of the drying operation of the heat pump type drying apparatus, the liquid compression of the compressor can be avoided, the drying time can be shortened and thus, energy conservation can be realized.

Next, the super heat control method will be explained in detail. In the heat pump type drying apparatus, optimal super heat exists in terms of efficiency and safety. The efficiency is most excellent when the super heat is zero (the state of the evaporator exit refrigerant is on a saturated vapor line), but in order to prevent the liquid compression of the compressor, a margin of safety is taken into account, the super heat of about 10 degrees is set to the optimal value in many cases. However, in the heat pump type drying apparatus, since the temperature condition of drying air is varied from the actuation to the completion of the drying operation, the super heat is also varied. With the variation of the super heat, the efficiency of the heat pump is deteriorated, and a danger of the compressor 31 operating to compress liquid exists. In this embodiment, however, the opening of the open/close valve 41 is varied in accordance with a detected super heat value, and the flow rate of drying air flowing into the bypass circuit 39 is varied. As a result, the super heat value can be converged on the target value. Thus, it is possible to operate the heat pump apparatus safely and efficiently. Although the temperature sensors are provided at the inlet and exit of the evaporator 34 as the super heat detecting device in this embodiment, the same effects can also be obtained even if a pressure sensor for detecting the sucking pressure of the compressor 31 and a temperature sensor for detecting the temperature of the exit of the evaporator 34 are provided.

Fourth Embodiment

Figure 5:
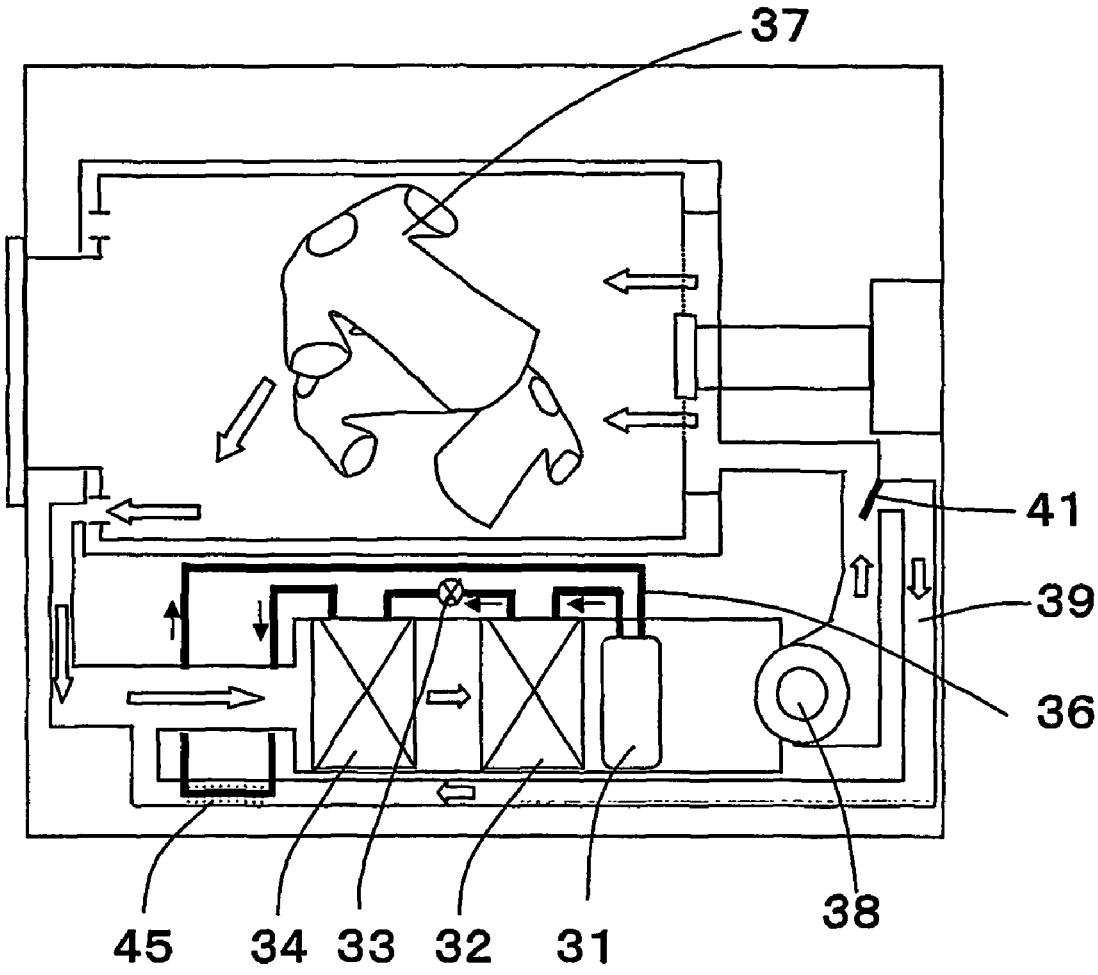
FIG. 5 is a block diagram of a heat pump type drying apparatus according to a fourth embodiment.
Figure 6:
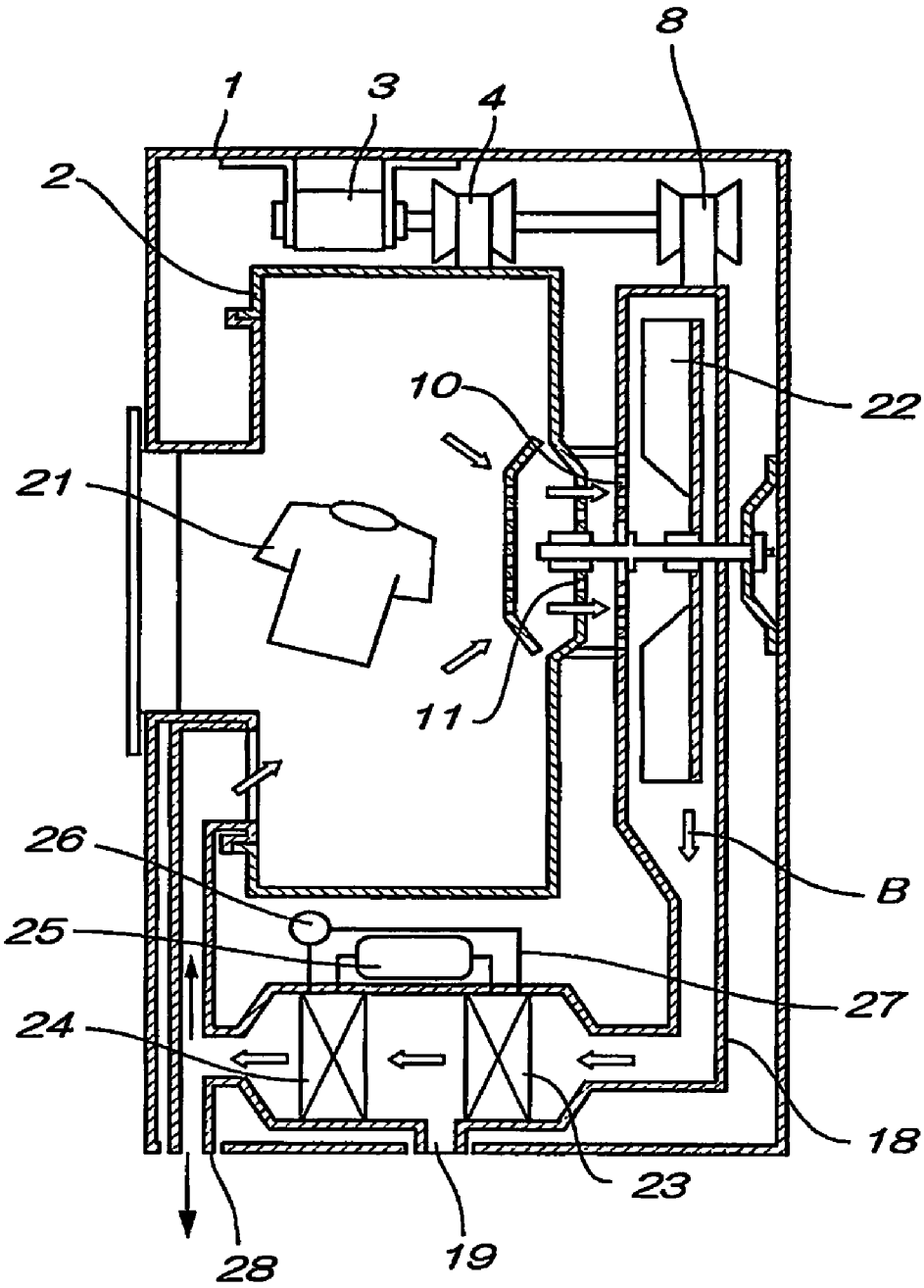
FIG. 6 is a block diagram of a conventional heat pump type drying apparatus.

FIG. 5 is a block diagram of a heat pump type drying apparatus according to a fourth embodiment of the invention. In FIG. 5, common constituent elements shown in FIG. 1 are designated with the same reference symbols, and explanation thereof will be omitted. A heat pump apparatus is constituted by connecting the compressor 31, the radiator 32, the expansion valve 33 and the evaporator 34 to one another through pipes 36, and by charging the refrigerant thereinto. As the refrigerant, a refrigerant which can be brought into a supercritical state on the radiating side, such as a $CO_2$ refrigerant for example, is charged.

In this embodiment, the bypass circuit 39 is provided therein with an air-refrigerant heat exchanger 45 (for example, a fin tube type heat exchanger) through which drying air flowing through the bypass circuit 39 heat-exchanges with a portion of the pipe between the compressor 31 and the evaporator 34.

According to this structure, the refrigerant heats the drying air in the air-refrigerant heat exchanger 45 in addition to the evaporator 34, and the same effects as that of the increase of a transfer area of the evaporator 34 can be obtained. As a result, the super heat is increased, and the pressure rising effect of the evaporator 34 is enhanced. Therefore, it is possible to increase the temperature range and the air quantity region in which the heat pump type drying apparatus can be operated.

If the open/close valve 41 is added to this embodiment, the flow rate of drying air flowing into the bypass circuit is adjusted, and the heat pump type drying apparatus is operated optimally, the energy-conservation effect can be obtained in addition to the above-described effects.

INDUSTRIAL APPLICABILITY

The heat pump type drying apparatus of the present invention has a bypass circuit through which a portion of drying air heated by a radiator flows to an inlet of an evaporator without coming into contact with a subject. The apparatus is effective for drying clothes, a bathroom, or any other item which needs to be dried or dehumidified. The apparatus can also be used for drying plateware, garbage and the like.

The invention claimed is:

1. A drying apparatus for drying a subject, wherein a refrigerant is circulated through a compressor, a radiator, an expansion mechanism and an evaporator through pipes, said drying apparatus comprising:

a drying air flow path operable to introduce drying air heated by the radiator to the subject to be dried, dehumidify the drying air which has been introduced to the subject by using the evaporator, and, heat the dehumidified drying air to return it into the drying air;

a bypass circuit through which a portion of the drying air heated by the radiator flows to the evaporator without coming into contact with the subject to be dried;

a bypass circuit flow rate detecting device operable to detect a flow rate of the drying air which flows into said bypass circuit; and a bypass air flow rate adjusting device operable to adjust the flow rate of the drying air flowing into said bypass circuit using a value detected by said bypass circuit flow rate detecting device.

2. A drying apparatus for drying a subject, wherein a refrigerant is circulated through a compressor, a radiator, an expansion mechanism and an evaporator through pipes, said drying apparatus comprising:

a drying air flow path operable to introduce drying air heated by the radiator to the subject to be dried, dehumidify the drying air which has been introduced to the subject by using the evaporator, and, heat the dehumidified drying air to return it into the drying air;

a bypass circuit through which a portion of the drying air heated by the radiator flows to the evaporator without coming into contact with the subject to be dried;

a super heat detecting device operable to detect super heat which is a difference between a refrigerant suction temperature of the compressor and a refrigerant evaporation temperature of the evaporator; and a bypass air flow rate adjusting device operable to adjust a flow rate of drying air flowing into said bypass circuit using a value detected by said super heat detecting device.

3. A drying apparatus for drying a subject, wherein a refrigerant is circulated through a compressor, a radiator, an expansion mechanism and an evaporator through pipes, said drying apparatus comprising:

a drying air flow path operable to introduce drying air heated by the radiator to the subject to be dried, dehumidify the drying air which has been introduced to the subject by using the evaporator, and, heat the dehumidified drying air to return it into the drying air; and a bypass circuit through which a portion of the drying air heated by the radiator flows to the evaporator without coming into contact with the subject to be dried wherein the drying air flowing through said bypass circuit heat-exchanges wit a portion of the pipes which is located between the compressor and the evaporator.

4. A drying apparatus for drying a subject, wherein a refrigerant is circulated through a compressor, a radiator, an expansion mechanism and an evaporator through pipes, said drying apparatus comprising:

a drying air flow path operable to introduce drying air heated by the radiator to the subject to be dried, dehumidify the drying air which has been introduced to the subject by using the evaporator, and, heat the dehumidified drying air to return it into the drying air;

a bypass circuit through which a portion of the drying air heated by the radiator flows to the evaporator without coming into contact with the subject to be dried;

a temperature detecting device operable to detect a temperature of the drying air dehumidified by the evaporator; and a bypass air flow rate adjusting device operable to adjust a flow rate of the drying air flowing into said bypass circuit using a value detected by said temperature detecting device.

5. A drying apparatus for drying a subject, wherein a refrigerant is circulated through a compressor, a radiator, an expansion mechanism and an evaporator through pipes, said drying apparatus comprising:

a drying air flow path operable to introduce drying air heated by the radiator to the subject to be dried, dehumidify the drying air which has been introduced to the subject by using the evaporator, and, heat the dehumidified drying air to return it into the drying air; and a bypass circuit through which a portion of the drying air heated by the radiator flows to the evaporator without coming into contact with the subject to be dried, wherein said drying air flow path is provided with a refrigerant accommodating container operable to accommodate a refrigerant, and wherein said refrigerant accommodating container is disposed in said drying air flow path at a location between a downstream portion of the radiator and an upstream portion of the evaporator.

6. A drying apparatus for drying a subject, wherein a refrigerant is circulated through a compressor, a radiator, an expansion mechanism and an evaporator through pipes, said drying apparatus comprising:

a drying air flow path operable to introduce drying air heated by the radiator to the subject to be dried, dehumidify the drying air which has been introduced to the subject by using the evaporator, and, heat the dehumidified drying air to return it into the drying air; and a bypass circuit through which a portion of the drying air heated by the radiator flows to the evaporator without coming into contact with the subject to be dried, wherein the compressor, radiator, and expansion mechanism are operated in a state in which a high pressure side thereof is in a supercritical state.

7. A heat pump type drying apparatus comprising:

a heat pump having a compressor, a radiator, an expansion mechanism and an evaporator connected via pipes through which a refrigerant is circulated;

a drying air flow path operable to introduce drying air heated by said radiator to a subject to be dried, dehumidify the drying air which has been introduced to the subject by using said evaporator, and heat the dehumidified drying air to return it into the drying air;

a bypass circuit through which a portion of the drying air heated by said radiator flows to said evaporator without coming into contact with the subject to be dried;

a bypass circuit flow rate detecting device operable to detect a flow rate of the drying air which flows into said bypass circuit; and a bypass air flow rate adjusting device operable to adjust the flow rate of the drying air flowing into said bypass circuit using a value detected by said bypass circuit flow rate detecting device.

8. A heat pump type drying apparatus comprising:

a heat pump having a compressor, a radiator, an expansion mechanism and an evaporator connected via pipes through which a refrigerant is circulated;

a drying air flow path operable to introduce drying air heated by said radiator to a subject to be dried, dehumidify the drying air which has been introduced to the subject by using said evaporator, and heat the dehumidified drying air to return it into the drying air;

a bypass circuit through which a portion of the drying air heated by said radiator flows to said evaporator without coming into contact with the subject to be dried;

a super heat detecting device operable to detect super heat which is a difference between a refrigerant suction temperature of said compressor and a refrigerant evaporation temperature of said evaporator; and a bypass air flow rate adjusting device operable to adjust a flow rate of drying air flowing into said bypass circuit using a value detected by said super heat detecting device.

9. A heat pump type drying apparatus comprising:

a heat pump having a compressor, a radiator, an expansion mechanism and an evaporator connected via pipes through which a refrigerant is circulated;

a drying air flow path operable to introduce drying air heated by said radiator to a subject to be dried, dehumidify the drying air which has been introduced to the subject by using said evaporator, and heat the dehumidified drying air to return it into the drying air; and a bypass circuit through which a portion of the drying air heated by said radiator flows to said evaporator without coming into contact with the subject to be dried, wherein the drying air flowing through said bypass circuit heat-exchanges with a portion of said pipes which is located between said compressor and said evaporator.

10. A heat pump type drying apparatus comprising:

a heat pump having a compressor, a radiator, an expansion mechanism and an evaporator connected via pipes through which a refrigerant is circulated;

a drying air flow path operable to introduce drying air heated by said radiator to a subject to be dried, dehumidify the drying air which has been introduce to the subject by using said evaporator, and heat the dehumidified drying air to return it into the drying air;

a bypass circuit through which a portion of the drying air heated by said radiator flows to said evaporator without coming into contact with the subject to be dried;

a temperature detecting device operable to detect a temperature of the drying air dehumidified by said evaporator; and a bypass air flow rate adjusting device operable to adjust a flow rate of the drying air flowing into said bypass circuit using a value detected by said temperature detecting device.

11. A heat pump type drying apparatus comprising:

a heat pump having a compressor, a radiator, an expansion mechanism and an evaporator connected via pipes through which a refrigerant is circulated;

a drying air flow path operable to introduce drying air heated by said radiator to a subject to be dried, dehumidify the drying air which has been introduced to the subject by using said evaporator, and heat the dehumidified drying air to return it into the drying air;

a bypass circuit through which a portion of the drying air heated by said radiator flows to said evaporator without coming into contact with the subject to be dried, wherein said heat pump type drying apparatus further comprises;

a refrigerant accommodating container disposed in the drying air flow path to accommodate a refrigerant, wherein said refrigerant accommodating container is disposed in said drying air flow path at a location between a downstream portion of said radiator and an upstream portion of said evaporator.

12. A heat pump type drying apparatus comprising:

a heat pump having a compressor, a radiator, an expansion mechanism and an evaporator connected via pipes through which a refrigerant is circulated;

a drying air flow path operable to introduce drying air heated by said radiator to a subject to be dried, dehumidify the drying air which has been introduced to the subject by using said evaporator, and heat the dehumidified drying air to return it into the drying air; and a bypass circuit through which a portion of the drying air heated by said radiator flows to said evaporator without coming into contact with the subject to be dried, wherein said heat pump is operated in a state in which a high pressure side thereof is in a supercritical state.

13. A drying method for drying a subject located within a circuit, said drying method comprising:

dehumidifying and heating air to obtain drying air having a high temperature and low moisture;

passing a portion of the drying air through the circuit to bring the portion of the drying air into contact with the subject; passing another portion of the drying air through a bypass circuit, the bypass circuit being arranged to avoid the another portion of the drying air from coming into contact with the subject;

mixing the portion of the drying air brought into contact with the subject and the another portion of the air passed through the bypass circuit to obtain the air;

adjusting a flow rate of the drying air which is passed through the bypass circuit; and detecting a temperature of the air after it is dehumidified and controlling said adjusting the flow rate of the drying air which is passed through the bypass circuit by using the detected temperature.

* * * * *